US005916078A

United States Patent [19]

Herrin

[11] Patent Number: 5,916,078

[45] Date of Patent: Jun. 29, 1999

[54] CONTAINER STUFFING OR NESTING APPARATUS

[76] Inventor: Robert M. Herrin, 5935 Groveline Dr., Orlando, Fla. 32810

[21] Appl. No.: 08/639,253

[22] Filed: Apr. 24, 1996

[51] Int. Cl.[6] ..... B31B 7/00

[52] U.S. Cl. ..... 493/93; 493/6; 493/29; 493/100; 493/907; 53/175

[58] Field of Search ..... 53/175, 156, 157, 53/238, 449; 493/3, 6, 23, 29, 34, 84, 89, 90, 93, 95, 96, 100, 101, 141, 142, 162, 217, 309, 313, 315, 317, 318, 319, 379, 390, 391, 417, 418, 450, 906, 907, 912

[56] References Cited

U.S. PATENT DOCUMENTS

| | | | |
|---|---|---|---|
| 2,082,565 | 6/1937 | Benoit . | |
| 2,160,518 | 5/1939 | Reynolds . | |
| 2,523,667 | 9/1950 | Palmer et al. . | |
| 2,966,020 | 12/1960 | Bacsak . | |
| 3,640,190 | 2/1972 | Fuller et al. | 493/270 |
| 3,818,676 | 6/1974 | Russell et al. . | |
| 4,089,150 | 5/1978 | Heisler | 493/181 |
| 4,137,830 | 2/1979 | Boyd | 493/29 |
| 4,237,777 | 12/1980 | Nowacki et al. | 493/100 |
| 4,917,659 | 4/1990 | Mohaupt et al. | 493/12 |
| 5,379,570 | 1/1995 | Terjung et al. | 53/458 |

*Primary Examiner*—Stephen F. Gerrity
*Assistant Examiner*—Steven Jensen
*Attorney, Agent, or Firm*—Allen, Dyer, Doppelt, Milbrath & Gilchrist, P.A.

[57] ABSTRACT

A container stuffing apparatus and method of stuffing or nesting containers are provided that preferably includes an erected outer container dispenser for dispensing one of a plurality of erected outer containers in a predetermined direction of manufacture and collapsed inner container dispenser positioned in a direction substantially transverse to the predetermined direction of manufacture for dispensing one of a plurality of collapsed inner containers. An erector is positioned downstream from the collapsed inner container dispenser in the direction substantially transverse to the predetermined direction of manufacture for erecting the dispensed and collapsed inner container. The erector preferably includes an advancer responsive to the collapsed inner container dispenser for advancing the dispensed inner container downstream during the erection of the inner container. An inner container inserter is responsive to the erector and the erected outer container dispenser for inserting the erected inner container into the open end of the dispensed erected outer container to thereby provide a stuffed container. A timing synchronization controller preferably is operatively connected to the dispenser, the erector, and the inner container inserter.

40 Claims, 6 Drawing Sheets

CONTAINER STUFFING OR NESTING APPARATUS

FIELD OF THE INVENTION

This application is related to container stuffing or nesting systems and, more particular, to a container stuffing or nesting apparatus arranged for positioning a packing element into a container.

BACKGROUND OF THE INVENTION

In the produce industry, for example, various packaging elements or containers, such as cartons or boxes formed of cardboard, wood, or polymeric materials, are often used to pack, store, and/or ship produce throughout the world. Packers or packing plants are often responsible for harvesting or gathering the produce, sorting and grading the produce, preparing the produce such as by washing and waxing, and packing the produce into containers for shipment. Because of the various industry demands on the packing plants such as needs for more timely deliveries, for lower or more control of labor costs, for more inventory control and lower inventory costs, for more control over the sorting and grading, preparing, and packing processes, problems have arisen at various stages of the sorting and grading, preparing, and packing processes.

One of the areas where problems have arisen is in the supply speed and control of the containers used for packing the produce. Conventionally, for example, containers may be formed of a cardboard material which is relatively inexpensive, relatively lightweight, and in many cases can be recycled. To strengthen the cardboard cartons or containers, for example, two cartons may be nested or stuffed to reinforce side panels and/or bottom panels to produce a resulting nested or stuffed container. Containers may also, for example, be nested or stuffed for labeling purposes and for situations where a top or cover may be desired. This stuffing or nesting process may include erecting a collapsed container, and then once it is erected the container is inserted into the open end of another erected container. This stuffing or nesting process, however, can be time consuming particularly where the needs in the industry are for increased stuffed container production speed without damage to the containers being produced.

Additionally, containers often have labels printed or affixed to outer surfaces of the containers for identifying and advertising the farms, cooperatives, packers, and/or wholesale distributors responsible for the produce. What often occurs is that a wholesale distributor desires its label to be on a container during the shipping process to identify and advertise its image to retailers and the consuming public. The wholesale distributor then requests that the packers or packing plants use containers having its label already affixed thereto. Packing houses then must use and track different labelled containers for different customers and coordinate the correctly labeled containers to keep a smooth and efficient operation in the packing plant. Because the outer carton or container will often need to have an appropriate label affixed thereto, this container label coordination problem further exacerbates the stuffed or nested container production problem as well, particularly where enhanced production speed is often needed.

OBJECTS AND SUMMARY OF THE INVENTION

With the foregoing in mind, it is an object of the present invention to provide a container stuffing or nesting apparatus and associated methods which enhance the production speed for stuffed or nested containers.

It is also an object of the present invention to provide a collapsed container erecting apparatus and method for erecting a collapsed container more quickly during a production process.

It is another object of the present invention to provide a collapsed inner container dispensing, erecting, and inserting apparatus and methods for dispensing and erecting a collapsed inner container and for inserting the erected inner container into an erected outer container more quickly during a stuffed or nested container production process.

It is a further object of the present invention to provide a packaging element and/or a container dispensing apparatus and method which more effectively dispenses containers such as for stuffing or nesting containers in a production process.

It is also another object of the present invention to provide a stuffing and/or nesting apparatus and associated methods which increase the production speed process for stuffed and/or nested containers without damaging the containers during higher speed production.

It is yet another object of the present invention to provide a stuffing or nesting apparatus and associated methods which more effectively control the timing synchronization of the steps in the production process.

More particularly, a container stuffing apparatus according to the present invention preferably includes erected outer container dispensing means for dispensing one of a plurality of erected outer containers. Each of the plurality of containers preferably has at least one open end. Collapsed inner container dispensing means is positioned upstream from the erected outer container dispensing means for dispensing one of a plurality of collapsed inner containers, and erecting means is positioned responsive to the collapsed inner container dispensing means for erecting the one dispensed and collapsed inner container. The erecting means preferably includes advancing means responsive to the collapsed inner container dispensing means for advancing the dispensed inner container downstream during the erection of the inner container. Inner container inserting means is positioned responsive to the erecting means and the erected outer container dispensing means for inserting the erected inner container into the open end of the dispensed erected outer container to thereby provide a stuffed container. Timing synchronization control means preferably is operatively connected to the collapsed inner container dispensing means, the erecting means, and the inner container inserting means for controlling the timing synchronization of the collapsed inner container dispensing means, the erecting means, and the inner container inserting means so that the dispensing means dispenses another one of the plurality of collapsed containers during the erecting of the collapsed container and the erecting means erects another collapsed inner container during the inserting of the erected inner container.

According to another aspect of the present invention, a container stuffing apparatus for enhancing the production speed of container stuffing is provided which preferably includes erected outer container dispensing means for dispensing one of a plurality of erected outer containers. Each of the plurality of erected outer containers preferably has at least one open end. The erected outer container dispensing means has metering means for operatively metering a plurality of erected outer containers during dispensing of an erected outer container and during discharging of a stuffed container so that the metering means advances a first one of the plurality of erected outer containers advances to a dispensed position for receiving an erected inner container, inhibits a second one of the plurality of erected containers from advancing to the dispensed positioned, and advances the stuffed container to a discharge position. Collapsed inner container dispensing means is positioned upstream from the erected outer container dispensing means for dispensing one of a plurality of collapsed inner containers, and erecting means is positioned downstream from the collapsed inner container dispensing means for erecting the one dispensed and collapsed inner container. Inner container inserting means preferably is also positioned downstream from the erecting means and upstream from the erected outer container dispensing means for inserting the erected inner container into the open end of the dispensed erected outer container to thereby provide a stuffed container.

The present invention further includes a container erecting and inserting apparatus for enhancing the production speed of erected containers. The container erecting and inserting apparatus preferably has collapsed container dispensing means for dispensing one of a plurality of collapsed inner containers, and erecting means positioned downstream from the collapsed container dispensing means for erecting the one dispensed and collapsed container. The erecting means preferably includes advancing means responsive to the collapsed container dispensing means for advancing the dispensed container downstream during the erection of the container. The apparatus further has container inserting means positioned downstream from the erecting means for forwardly inserting the erected container downstream. Timing synchronization control means is preferably operatively connected to the collapsed container dispensing means, the erecting means, and the container inserting means for controlling the timing synchronization of the collapsed container dispensing means, the erecting means, and the container inserting means so that the dispensing means dispenses another one of the plurality of collapsed containers during the erecting of the collapsed container and the erecting means erects another collapsed container during the inserting of the erected container.

The present invention also includes a container dispensing apparatus for enhancing the production speed of containers. The container dispensing apparatus preferably has a container conveyor positioned in a generally horizontal plane for conveying a plurality of containers, and a container meter responsive to the container conveyor for operatively metering the plurality of containers during dispensing of a container to a dispensed position and individual discharging of a container from the dispensed position so that the container meter advances a first one of the plurality of containers to the dispensed position, inhibits a second one of the plurality of containers from advancing to the dispensed positioned, and advances the dispensed container to a discharge position.

The present invention further includes methods of stuffing or nesting containers. A method according to the present invention, for example, preferably include erecting a collapsed inner container during downstream advancement of the inner container and inserting the erected inner container into an open end of an erected outer container to thereby form a resulting stuffed container. The method may also include erecting another collapsed container during the inserting of the erected container.

A method of stuffing or nesting an inner container into an open-ended outer container is also provided which preferably includes increasing the advancement of a first of a plurality of open-ended and erected outer containers being conveyed on a moving conveyor to a dispensed position, slowing the advancement of a second of the plurality of open-ended and erected outer containers being conveyed on the moving conveyor to the dispensed position, and inserting an erected inner container into the open end of the first of the plurality of open-ended and erected outer containers. This method may also include, for example, erecting a collapsed inner container during downstream advancement of the inner container.

The present invention additionally provides a method of dispensing and erecting containers. This method preferably includes dispensing a first collapsed container, erecting the first collapsed container during downstream advancement of the first container, and dispensing a second collapsed container during the step of erecting the first collapsed container. The step of erecting the first collapsed container preferably includes holding a lower surface of the first collapsed container by vacuum pressure during the downstream advancement of the first container and lifting the upper surface of the first collapsed container by vacuum pressure during the downstream advancement of the first container. The method may also include maintaining vacuum pressure on the erected first container during downstream advancement of the first container. By including this latter step, for example, the method can inhibit the first container from returning to the collapsed position during downstream advancement to guides rails or other operations. This method, for example, can not only be used for stuffing and/or nesting containers, but may also advantageously be used for sealing the collapsed container, e.g., bottom or top panels of the container, once it is erected and other related methods as well according to the present invention.

By providing an arrangement and timing synchronization control for the dispensing, erecting, and/or inserting steps in the production process, a stuffing or nesting apparatus according to the present invention enhances the production speed for stuffed or nested containers. Also, because these steps are effectively arranged and controlled, the apparatus can provide high speed production of stuffed or nested containers within a small floor space or area of the container production process. By providing an arrangement and timing synchronization control of the erected container dispensing process, a stuffing or nesting apparatus according the present invention further controls and/or meters a plurality of erected containers so that the containers are effectively stuffed or nested during production at increased speeds. The present invention also preferably enables aspects of the invention to be combined to further enhance the production speed of stuffed or nested containers without damage to the containers during the higher speed production. This invention, for example, thereby advantageously provides a stuffing or nesting apparatus which enables assembly plants or produce packing plants to lower labor costs, provide additional flexibility in container labeling, and increase production output.

BRIEF DESCRIPTION OF THE DRAWINGS

Some of the objects, features, advantages, and uses of the present invention having been stated, others will become more apparent by referring to the following detailed description and drawings in which.

DETAILED DESCRIPTION

The present invention will now be described more fully hereinafter with reference to the accompanying drawings in which preferred embodiments of the invention are shown. This invention, however, may be embodied in many different forms and should not be construed as limited to the illustrated embodiments set forth herein. Rather, applicants provide these embodiments so that this disclosure will be thorough and complete, and will fully convey the scope of the invention to those skilled in the art. Like numbers refer to like elements throughout.

Figure 1:
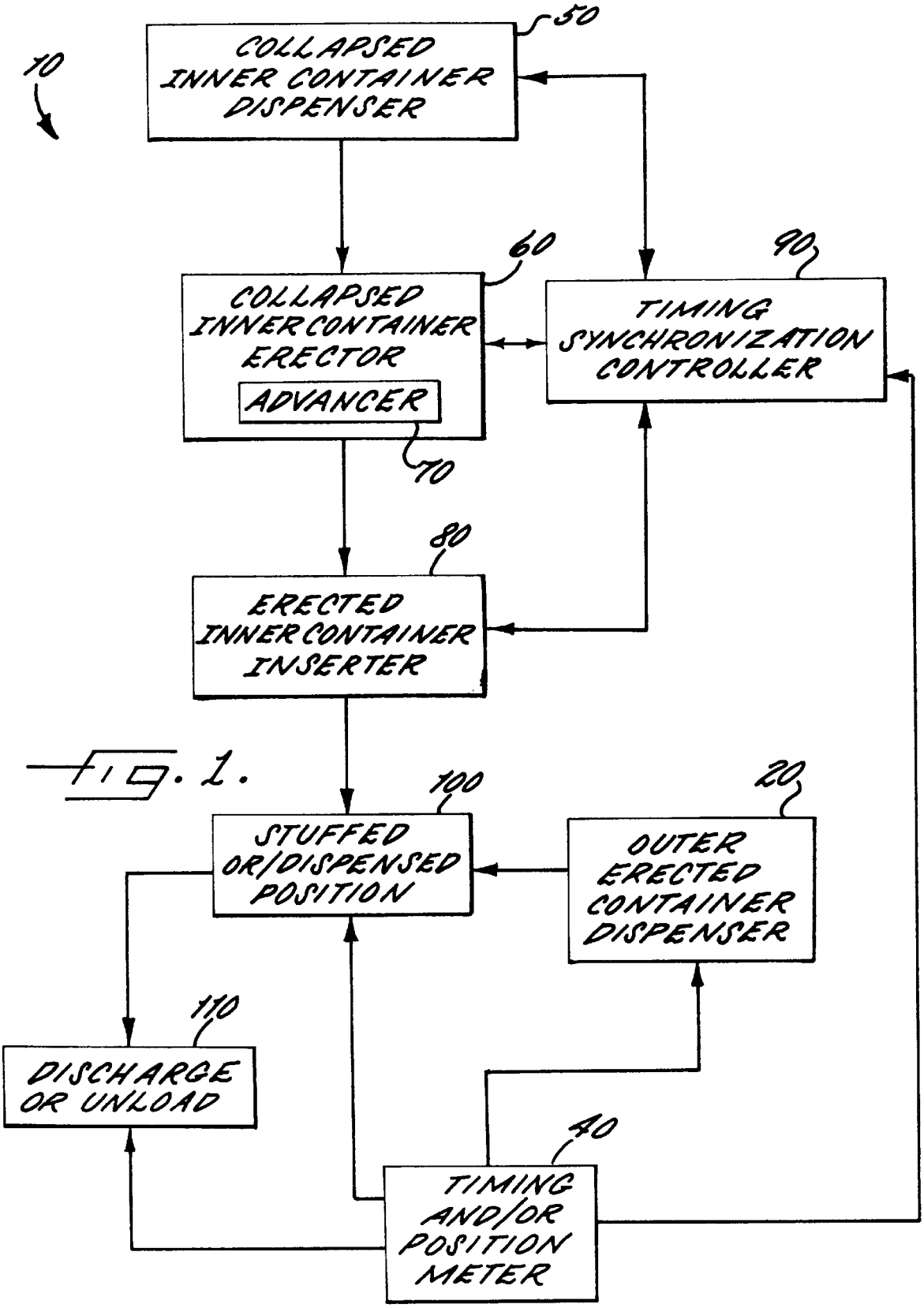
FIG. 1 is a schematic block diagram of a container stuffing or nesting apparatus according to the present invention.

FIG. 1 schematically illustrates a container stuffing or nesting apparatus 10 according to the present invention. In overview, the apparatus 10 preferably includes an outer container dispensing means 20 for dispensing at least one of a plurality of outer containers E, an inner container or packaging element dispensing means 50 positioned upstream from the outer container dispensing means, for dispensing at least one of a plurality of inner containers, erecting means 60 positioned downstream from the inner container dispensing means for erecting an inner container, and an inner container inserting means 80 positioned downstream from the erecting means for inserting an erected inner container C into an open end of an erected outer container E. The erecting means 60 preferably includes advancing means 70 responsive to the inner container dispensing means 50 for advancing an inner container C downstream during the erection process. Timing synchronization control means 90 is at least connected to the inner container dispensing means 50, the erecting means 60, and the inserting means 80 for controlling the timing synchronization of the inner container dispensing means 50, the erecting means 60, and the inserting means 80 so that the dispensing means 50 dispenses another collapsed inner container C during the erecting of the collapsed inner container card the erecting means 60 erects another collapsed inner container during the inserting of the erected inner container C.

For purposes of this description, upstream and downstream should be understood as being positioned before the source or resulting stuffed container 100 wherein the erected inner container is positioned into the erected outer container. As illustrated in FIG. 1, there are, however, two upstream and downstream process directional flows. The first and primary directional flow being from the collapsed container dispensing, to the erecting, to the inserting, to the stuffing, and to the discharging 110 of the stuffed container. The second or secondary directional flow is from the plurality of erected outer containers E traveling toward the stuffed or dispensed position 100. It will be understood, however, that the secondary process of dispensing the erected containers E and the erected outer container dispenser 20 according to the present invention will be positioned downstream from and downstream in the process of the inner container dispensing, erecting, and inserting aspects of the invention.

As best illustrated in FIGS. 2–7, a container stuffing apparatus 10 for enhancing the production speed of stuffed or nested containers is described in more detail and preferably includes erected outer container dispensing means, e.g., an outer container dispenser 20, for individually dispensing one of a plurality of a rectangular-shaped erected outer containers E having at least one open end O. These inner and outer containers C, E, for illustrative purposes, are preferably cartons formed of cardboard or other paper material, but as understood by those skilled in the art the containers E according to the present invention may be formed of other materials such as plastic or polymeric materials and pressboard or wood-based materials. The inner container C could also be other packaging elements such as cardboard inserts or plastic packing inserts which need to be positioned within a container E according to the present invention.

Figure 2:
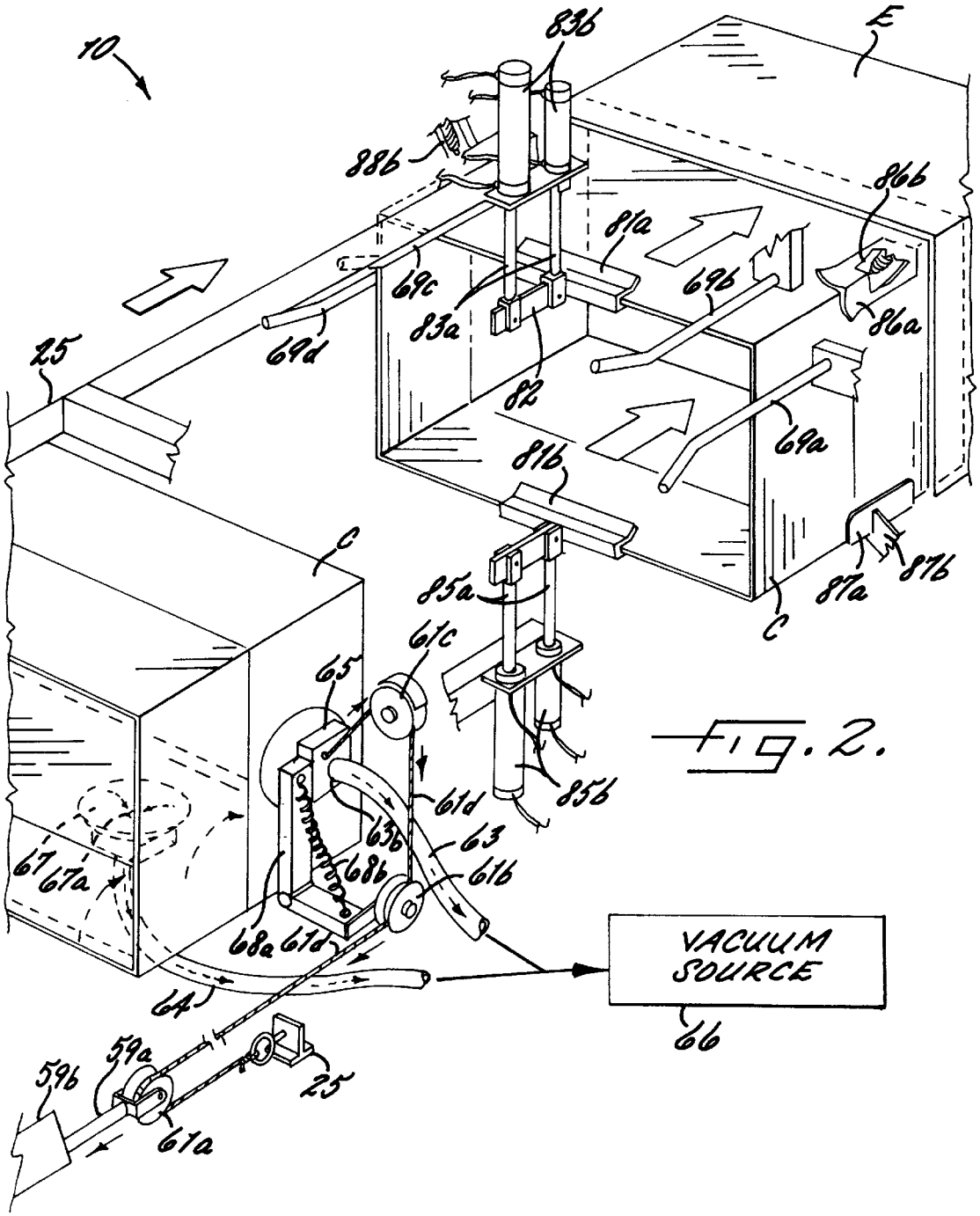
FIG. 2 is a perspective view of a container erector and inserter of a container stuffing or nesting apparatus according to the present invention.
Figure 3:
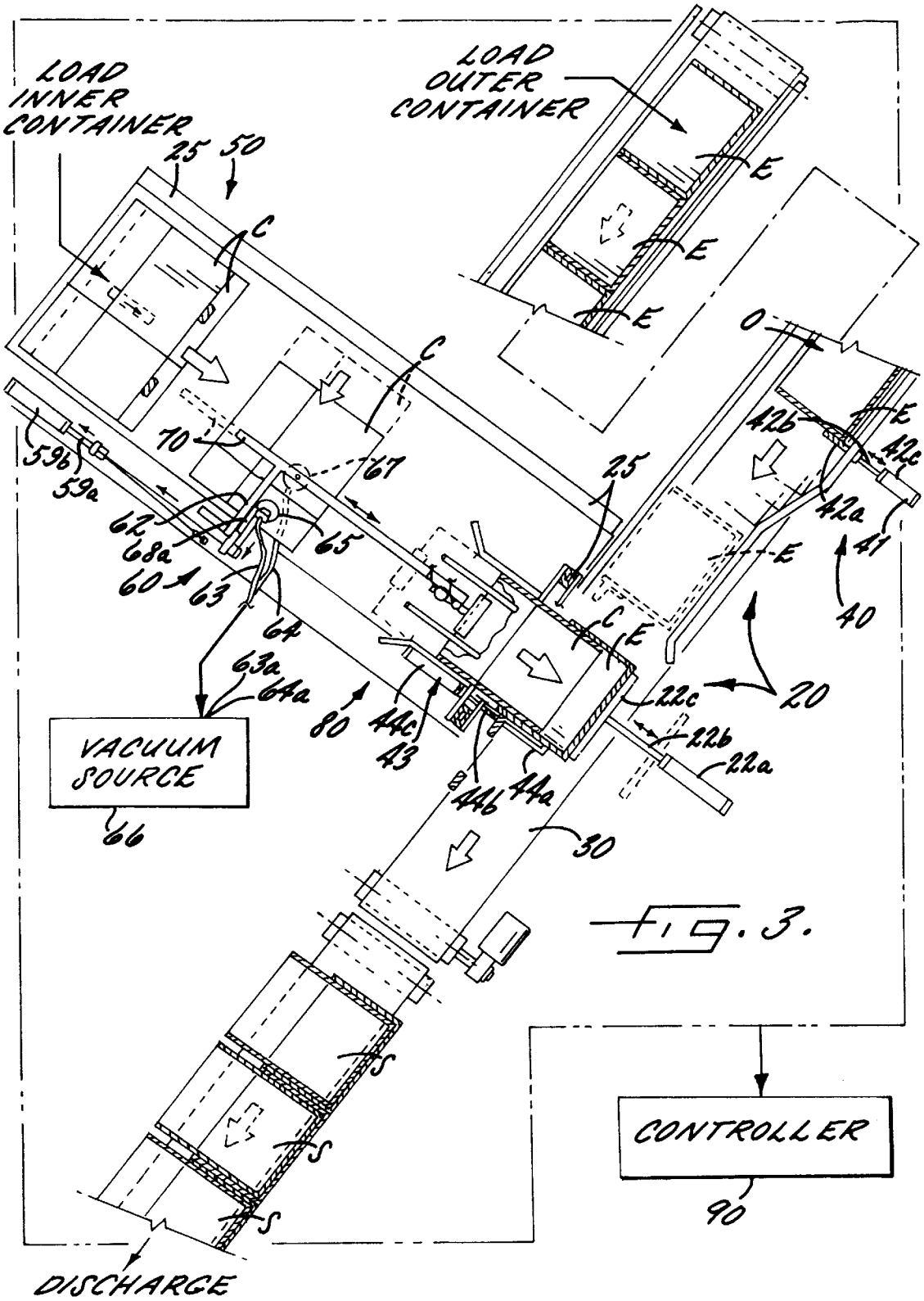
FIG. 3 is a top plan view of a container stuffing or nesting apparatus according to the present invention.

The erected outer container dispenser 20 as illustrated preferably includes a frame 25, an erected outer container advancing means, e.g., a conveyor 30, mounted to the frame 25 and positioned in a generally horizontal plane for advancing a plurality of erected outer containers E along a generally horizontal path of travel (see, e.g., directional arrows in FIGS. 2–3). Outer container metering means, e.g., a meter 40, is also mounted to the frame 25 and is responsive to the outer container conveyor 30 for operatively metering the plurality of erected outer containers E during individual dispensing of an erected outer container E and individual discharging of a stuffed container S so that the meter 40 advances a first one of the plurality of erected outer containers E to a dispensed position for receiving an erected inner container C, inhibits a second one of the plurality of erected containers E from advancing to the dispensed positioned 100, and advances the stuffed container S to a discharge position 110. As illustrated in FIG. 3, the outer container dispenser 20 also includes a container retaining gate 22*a*, 22*b*, 22*c* preferably connected to the frame for retaining the erected container E in position during forward thrusting movement of the insert 80 so that the erected container and/or the stuffed container are not transversely discharged from conveyor 30.

The stuffing apparatus 10 further includes collapsed inner container dispensing means, e.g., an inner container dispenser 50, positioned upstream from the erected outer container dispensing means 20 for dispensing a collapsed inner container C. The collapsed inner container dispensing means 50 is also mounted to the frame 25 and preferably includes a plurality of stacked collapsed inner containers C positioned for dispensing such as illustrated. The dispenser 50 preferably individually dispenses one of the plurality of collapsed inner containers C in a generally horizontal plane along a path of travel as best illustrated in FIG. 3. It will be understood by those skilled in the art that other paths of travel and orientations of the inner containers C or packaging elements may be used as well according to the present invention.

Inner container erecting means, e.g., an erector 60, is positioned downstream from and responsive to the collapsed inner container dispenser 50 for individually erecting the dispensed and collapsed inner container C. The inner container erector 60 preferably includes an inner container conveyor 70 (e.g., advancing means) positioned in a generally horizontal plane downstream from the inner container dispenser 50 and traverse to the outer container conveyor 30. The inner container conveyor 70 also is preferably responsive to the collapsed inner container dispenser 50 for conveying the dispensed inner container C toward the dispensed outer container E during the erection of the inner container C.

Because of the arrangement and synchronization between the inner container dispenser 50, the erector 60, and the conveyor 70, the stuffing apparatus 10 according to the invention can significantly increase the erecting and inserting speed of prior systems. It more efficiently utilizes space and reduces downtime between operational process steps. The inner and outer conveyors 30, 70 also are preferably positioned generally perpendicular to each other so that an erected inner container C may be more easily positioned into or stuffed into the open end O of an erected outer container E to form a resulting stuffed container S.

As best illustrated in FIGS. 2–4B, the inner container erector 60 preferably includes a movable carriage 62, such as a sliding frame of vertically and transversely extending frame members, positioned adjacent the plane of travel of the inner container conveyor 70 and the dispense inner container C positioned thereon for carrying at least portions of the erector 60 during downstream advancement by the inner container conveyor 70. The erector 60 further includes a vacuum source 66 for supplying a vacuum and a pair of elongate tubes 63, 64 having proximal ends 63*a*, 64*a* thereof connected to the vacuum source 66. One 63 of the pair of elongate tubes 63, 64 has portions thereof mounted to the carriage 62. A retractable upper contact member 65 is mounted to the carriage 62, connected to a distal end 63*b* of the one 63 of the pair of elongate tubes 63, 64, and is arranged to be positioned to overlie the dispensed collapsed inner container C in an engaged position. The retractable upper contact member 65 has an opening 65*a* or an orifice formed therein positionally aligned with the distal opening of the one of the pair of elongate tubes 63, 64 for providing vacuum contact to an upper surface of the collapsed inner container C to thereby lift the upper surface of the collapsed inner container C to an erect position (see FIGS. 4A–4B). The retractable upper contact member 65 is also arranged to be positioned upwardly and away from the inner container conveyor 70 in a disengaged position.

A lower contact member 67 is connected to a distal end 64*b* of the other 64 of the pair of elongate tubes 63, 64 for contacting a lower surface of the inner container C. The lower contact member 67 has an opening 67*a* or orifice formed therein positionally aligned with the distal opening of the other 64 of the pair of elongate tubes 63, 64 for providing vacuum contact to a lower surface of the collapsed inner container C to thereby hold the lower surface of the collapsed inner container C during erection.

Figure 4A:
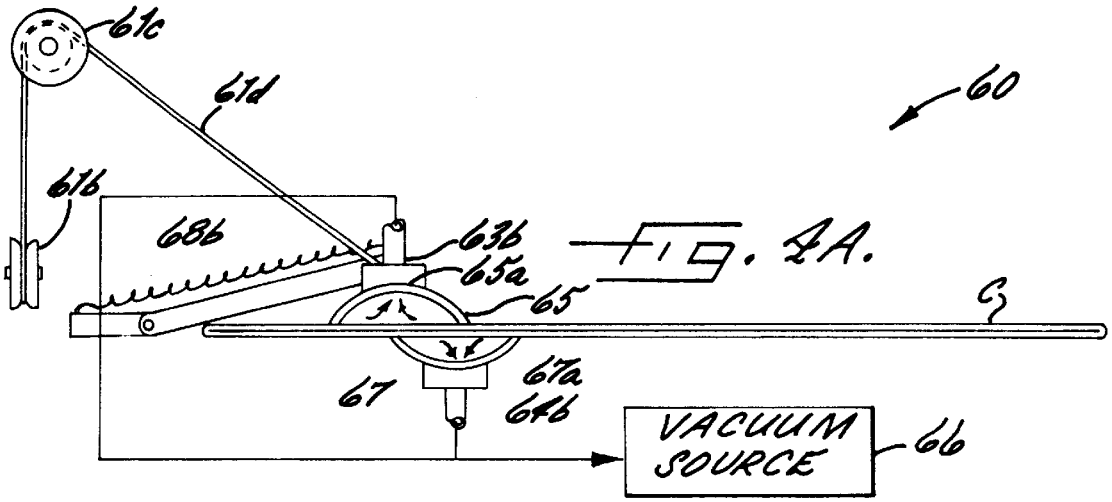
FIG. 4A is a front elevational view of a container erector of a container stuffing or nesting apparatus having a collapsed container positioned thereon according to the present invention.
Figure 4B:
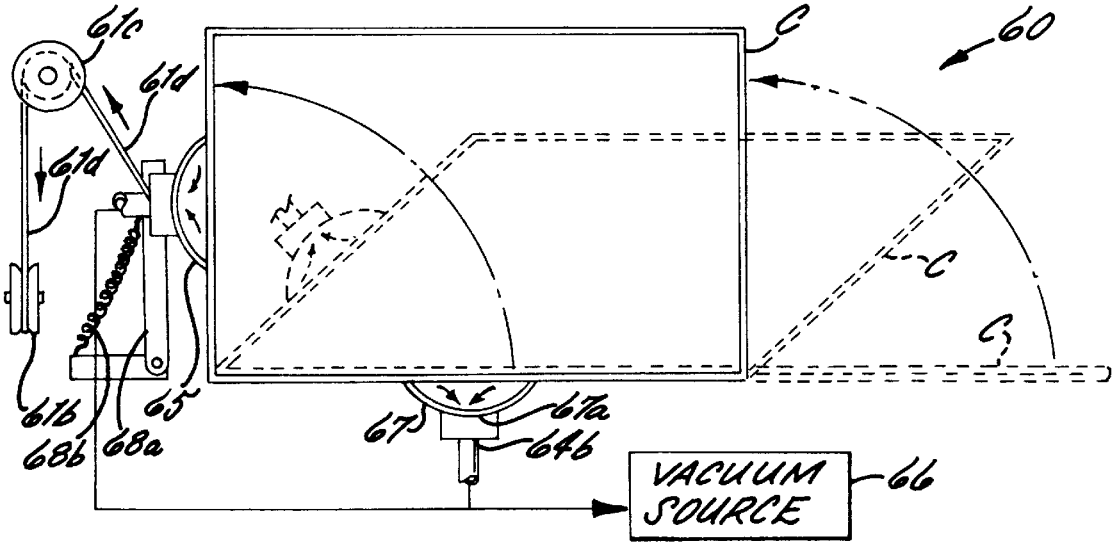
FIG. 4B is a front elevational view of a container erector of a container stuffing or nesting apparatus having an erected container positioned thereon and illustrating the erecting process in phantom lines according to the present invention.

As illustrated in FIGS. 2 and 4A–4B, the movable carriage 62 of the inner container erector 60 further has a pivot arm 68*a* connected to the retractable upper contact member 65 for pivotally moving the upper contact member 65 from the engaged position to the disengaged position. The pivot arm 68*a* preferably has a lower end thereof positioned closely adjacent the lower end of the collapsed and erected inner container C, as illustrated in FIGS. 4A–4B, so that the container C is not lifted or erected beyond a normal erected position. Biasing means, e.g., a coiled spring 68*b*, is connected to the pivot arm 68*a* for biasing the pivot arm 68*a* in the engaged position. Also, lifting means, e.g., at least one pulley, and preferably a plurality of pulleys 61*a*, 61*b*, 61*c* as illustrated, having an elongate cord member 61*d* slidably positioned thereon, is connected to the pivot arm 68*a* and preferably to a portion of the frame 25, as illustrated in FIG. 2, for lifting the pivot arm 68*a* upwardly and away from the inner container conveyor 70 during movement of the inner container conveyor 70 such as when erecting a collapsed inner container positioned on the conveyor 70.

Additionally, the erector 60 includes erected position maintaining means, illustrated in FIG. 2 as a piston 59*a* and cylinder 59*b* connected to the proximal pulley 61*a*, connected to the lifting means for positionally maintaining, e.g., position dwelling, the pivot arm 68*a* in the upward position away from the inner container conveyor 70. The cylinder 59*b* preferably is connected to a portion of the frame 25 and to a positive pressure source, or is a positive pressurized cylinder, having a pressure relieving regulator so that the piston 59*a* maintains a retracted position until the lifting means lifts the upper surface of the collapsed container C to an erected position. At that time, the conveying pressure from the motion of the conveyor 70 is great enough to overcome the pressure of the cylinder 59*b* and the piston 59*a* begins to extend. This allows the vacuum member 65, with the vacuum pressure applied, to maintain the erected inner container C in an erect position until it is positioned behind the guide rails 69*a*, 69*b*, 69*c*, 69*d* which then maintain the inner container C in an erect position for insertion into the outer container E. The vacuum pressure on the vacuum member 65 is then released, the pivot arm 68*a* maintains its upward position, and the piston 59*a* retracts. When the pivot arm 68*a* reaches the position where the piston 59*a* is fully retracted, the conveyor 70 continues to return for erecting another or a second collapsed container C and the pivot arm 68*a* gradually extends downward to its biased position overlying the second collapsed container C. It will be understood by those skilled in the art that other types of position maintaining means such as a cam and dwell would also be included in the erector 60 of the present invention. The erector 60 as described, however, advantageously provides a simple and flexible erecting means which also allows an operator of the apparatus 10 to effectively maintain the apparatus 10 during the stuffing operation or other status arrangements.

Figure 8:
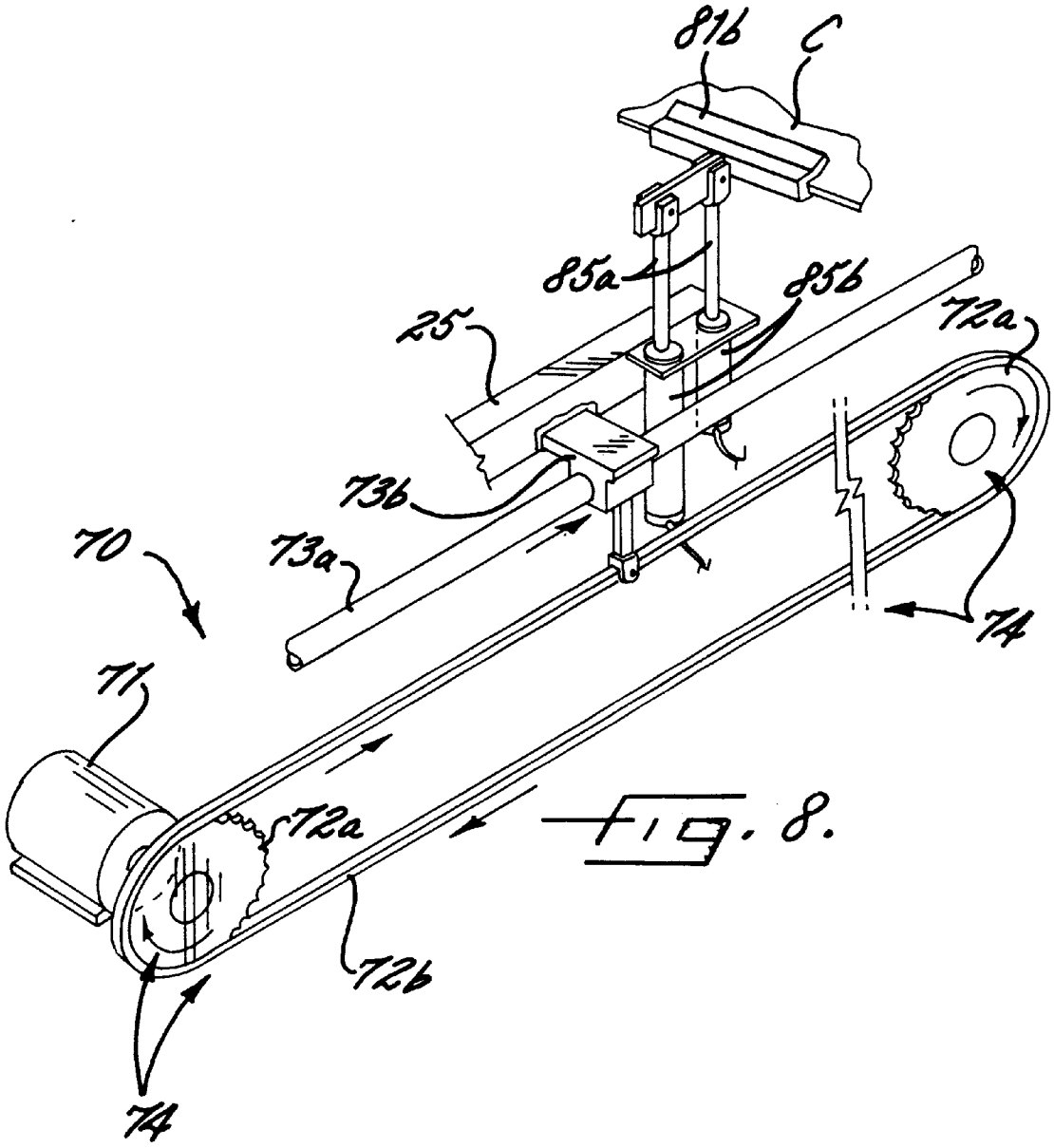
FIG. 8 is a side elevational view of an advancer or conveyor of an inner container erector and inserter of a container stuffing or nesting apparatus according to the present invention.

As best shown in FIGS. 3 and 8, the erector 60 further has a conveyor drive 72*a*, 72*b*, 72*c*, e.g., an A-C motor 71, a drive decelerator 74 including sprockets or gear 72*a* and a drive chain 72*b*, and a conveyor drive mount 72*c*, mounted to the inner container conveyor 70 for driving the inner container conveyor 70 in the generally horizontal plane along a rail 73*a* slidably positioned into at least one rail guide 73*b*. The conveyor drive 72*a*, 72*b* preferably includes the drive decelerator 74, or other decelerating means, for decelerating the drive speed of the inner container conveyor 70 as the erected inner container C conveyed thereon is being inserted into the open end O of the erected outer container E and as the dispensed collapsed container C is beginning to be conveyed to thereby provide a more smooth conveying movement. The chain and sprocket arrangement illustrated allows for this smooth conveying movement at both ends of the sliding conveyor 70. The conveyor 70 preferably is further connected and arranged to the dispenser 50, the erector 60, and the inserter 80 so that during one stroke or slidable movement the inner container C positioned thereon is erected and beginning to be inserted into the outer container E. The conveyor 70 then returns for positioning the next dispensed collapsed container thereon and erecting the next container during the advancement downstream. A plurality of guide rails 69*a*, 69*b*, 69*c*, 69*d* are preferably positioned downstream from the conveyor 70 and cooperate with the inserter 80 for guiding the erected inner container C into the erected outer container E.

As illustrated in FIGS. 2–3 and 6–7, inner container inserting means, e.g., a inserter 80, is positioned downstream from and responsive to the inner container erector 60 and positioned upstream from and responsive to the erected outer container dispenser 20 for inserting the erected inner container C into the open end O of the dispensed erected outer container E to thereby provide a stuffed container S. The inner container inserter 80 of the container stuffing apparatus 10 preferably has at least two retractable pushing arms 82, 84, e.g., thrusters, positioned to abuttingly contact periphery portions of the erected inner container C for pushing the erected inner container C from a retracted non-stuffed position to an extended stuffed position and at least two guide members positioned downstream from the at least two retractable pushing arms 82, 84 for guiding the erected inner container C during the pushing thereof into the open end O of the erected outer container E (see FIGS. 2 and 6). The two retractable pushing arms 82, 84 each include an elongate channel member 81*a*, 81*b* positioned to receive peripheral portions or edges of a container therein, a pair of pistons 83*a*, 85*a* connected to the channel member 81*a*, 81*b*, and a pair of cylinders 83*b*, 85*b* positioned to retract and extend the pistons 83*a*, 85*a* as understood by those skilled in the art. As understood by those skilled in the art, additional pushing arms and/or other types of inserters may be used according to the present invention. The pushing arms 82, 84 timely retract and extend so as not to interfere with the next inner container C being erected during the inserting or forwardly thrusting process of the invention. The guide rails 69*a*, 69*b*, 69*c*, 69*d* also may be used to maintain the erected inner container C in the erect position during the thrusting movement of the pushing arms 82, 84.

Figure 6:
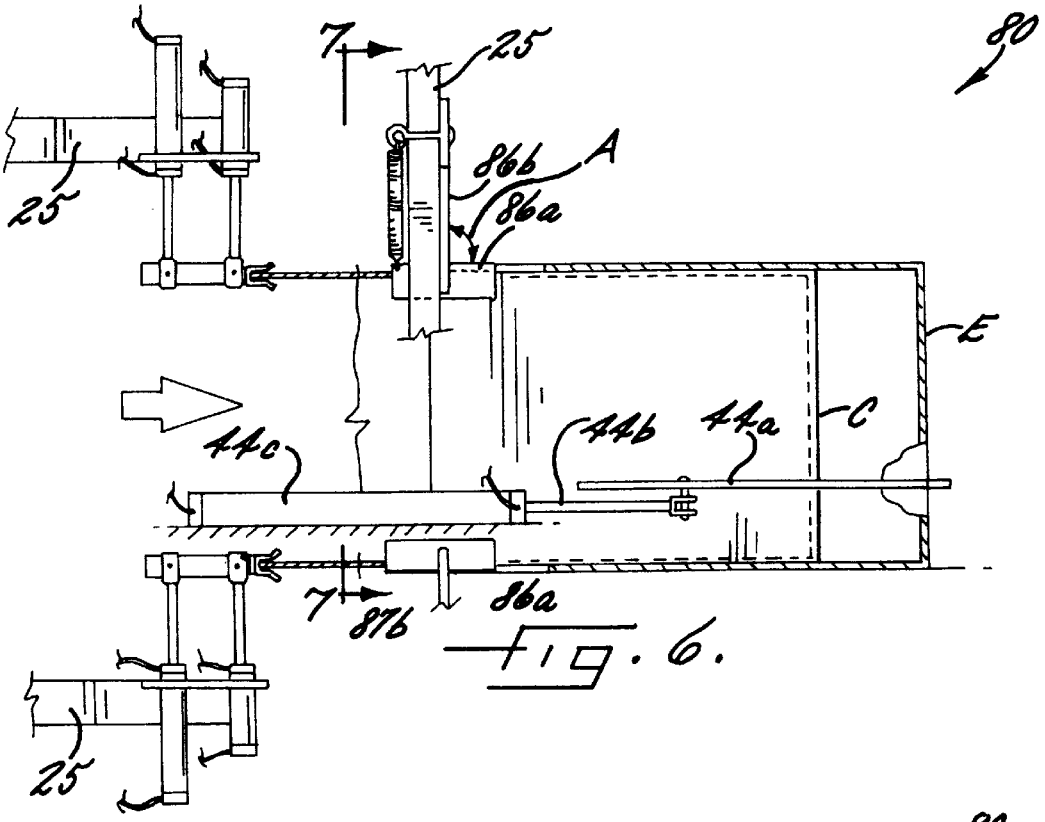
FIG. 6 is a side elevational view of a container inserter of a container stuffing or nesting apparatus according to the present invention.
Figure 7:
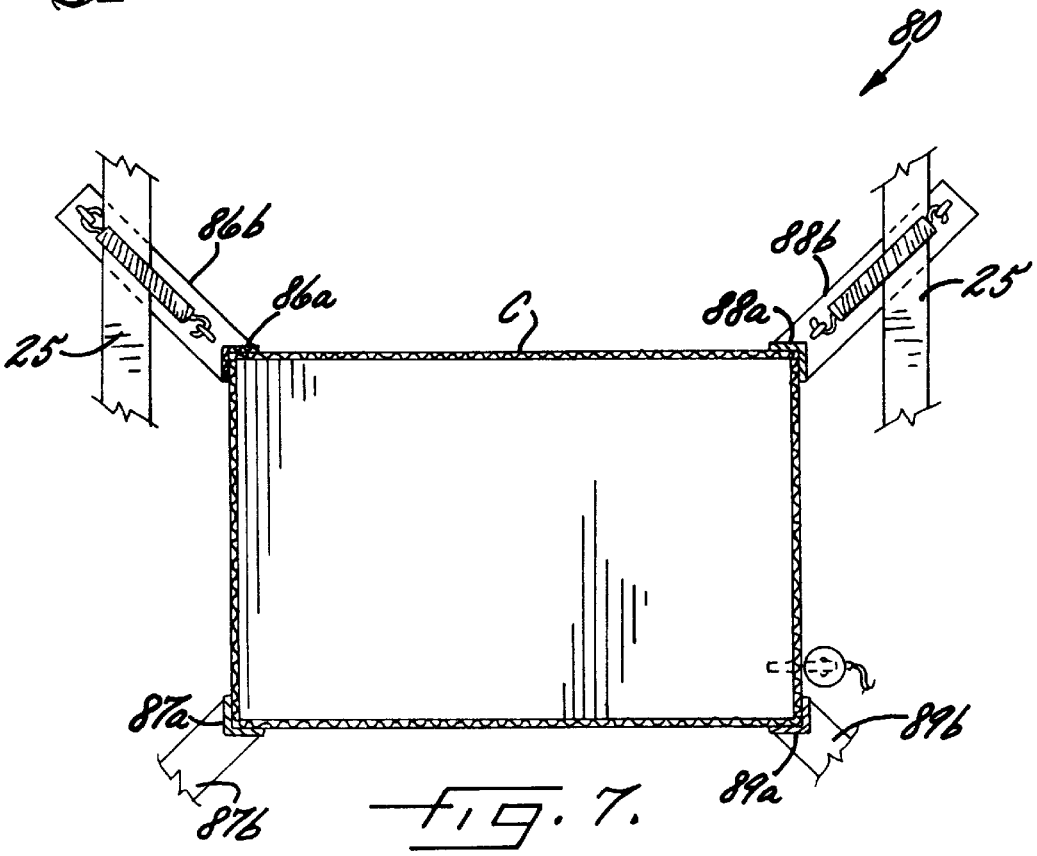
FIG. 7 is front elevational view of a container inserter including upper corner guides of a container stuffing or nesting apparatus according to the present invention.

As illustrated, the at least two guide members preferably are four corner guides 86*a*, 87*a*, 88*a*, 89*a* respectively positioned to receive the four corners of the erected inner container and to pivotally guide the four corners during insertion into the open end of the erected outer container (see FIGS. 6–7). The corner guides 86*a*, 87*a*, 88*a*, 89*a* are preferably positioned so that distal end portions of the corner guides 86*a*, 87*a*, 88*a*, 89*a* pivotally extend into peripheral edge portions of the open end of the erected outer container E. A plurality of pivotal mounts 86*b*, 87*b*, 88*b*, 89*b* is respectively connected to the four corner guides 86*a*, 87*a*, 88*a*, 89*a* for pivotally mounting the four corner guides 86*a*, 87*a*, 88*a*, 89*a* to inhibit damage to the erected inner container C during insertion into the open end O of the erected outer container E. These pivotal mounts 86*b*, 87*b*, 88*b*, 89*b* preferably include an adjustable pivot stop member which limits the range or angle A of pivot to a predetermined position, e.g., about a 90 degree horizontal orientation from the vertically extending frame 25 to which the corner guides 86*a*, 87*a*, 88*a*, 89*a* are mounted. Because the arrangement of these pivot mounts 86*b*, 87*b*, 88*b*, 89*b* advantageously extend the length of the lever operation of the mounts 86*a*, 87*b*, 88*b*, 89*b*, the corner guides 86*a*, 87*a*, 88*a*, 89*a* have enhanced flexibility which allow the contact of the container C to create the pivoting motion and further protect the inner container C from damage during the inserting process, especially during enhanced or higher speed operations.

The stuffing apparatus 10 according to the present invention further preferably has timing synchronization control means, e.g., a controller 90, operatively connected to the erected outer container dispenser 20, the collapsed inner container dispenser 50, the inner container erector 60, and the inner container inserter 80 for controlling the timing synchronization of the collapsed inner container dispenser 50, the erector 60, and the inserter 80 so that during the erecting of the collapsed container C the inner container dispenser 50 dispenses another one of the plurality of collapsed containers C and during the inserting of the erected inner container C the erector 60 erects another collapsed inner container C. The controller 90 preferably includes position or motion trackers such as a plurality of optical encoders positioned to track and control the motion of the conveyor 70, the erector 60, the inserter 90, and/or the meter 40 and at least one microprocessor connected to the position or motion trackers for processing and controlling data representative of the motion and position. As understood by those skilled in the art, the microprocessor includes software or machine coded data programs which operate to provide command control of the various functions of the apparatus 10 as described. Preferably, the microprocessor is a part of a computer system or programmable controller system operatively connected to these components of the apparatus 10 for enhanced operational system control. It will also be understood by those skilled in the art that other hardware and software control functions would also be applicable to the present invention.

By providing an arrangement and timing synchronization control for the dispensing, erecting, and inserting steps in the production process, a stuffing apparatus 10 according to the present invention enhances the production speed for stuffed or nested containers S. By providing an arrangement and timing synchronization control of the erected container dispensing, a stuffing or nesting apparatus 10 according to the present invention meters or coordinates the positioning and timing of a plurality of erected containers so that the containers are effectively stuffed or nested during production at increased speeds. The present invention also enables aspects of the invention to be combined to further enhance the production speed of stuffed or nested containers S without damage to the containers during the higher speed production. This invention allows, for example, assembly plants or produce packing plants to lower labor costs, provide additional flexibility in container labeling, and increase production output.

Figure 5:
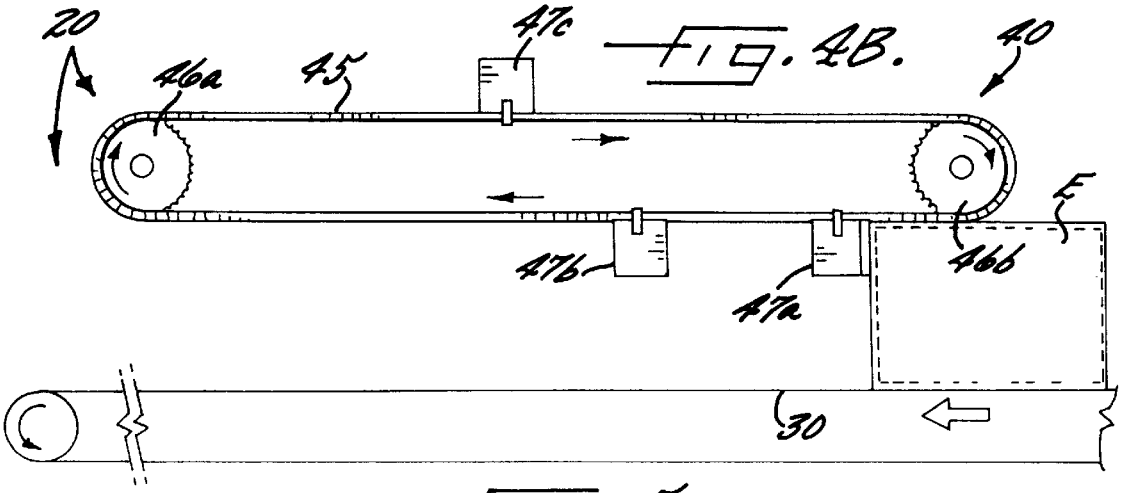
FIG. 5 is a front elevational view of a container meter of an erected container dispenser of a container stuffing or nesting apparatus according to the present invention.

As best illustrated in FIGS. 3 and 5, the outer container meter 40 preferably has a stop gate 41 positioned to stop conveying movement of the plurality of erected outer containers E being conveyed by the outer container conveyor 30 toward the dispensed position. The stop gate 41 preferably is mounted to the frame 25 and has a stop member 42*a*, a piston 42*b* mounted to the stop member 42*a*, and a cylinder 42*c* receiving the piston 42*b* for providing retracted and extended positions of the stop member 42*a* as understood by those skilled in the art. A guide gate 43 preferably is positioned to guide and stop conveying movement of the erected dispensed container E during insertion of the inner erected container C in a closed position and to releasably permit advancement by the outer container conveyor 30 to discharge the stuffed container S in an open position. Likewise, the guide gate 43 preferably is mounted to the frame 25 and has a guide stop member 44*a*, a piston 44*b* mounted to the guide stop member 44*a*, and a cylinder 44*c* receiving the piston 44*b* for providing retracted and extended positions of the guide stop member 44*a* as understood by those skilled in the art.

A metering chain 45 mounted to at least one drive, e.g., motors, having sprockets 46*a*, 46*b* thereon preferably overlies the elongate conveyor 30 (see FIG. 5). A plurality of metering arms 47*a*, 47*b*, 47*c* are connected to the metering chain 45 for metering and/or controlling the dispense and discharge timing of the erected outer containers E. An inhibiting arm 47*a*, as illustrated, connects to and extends downwardly from the metering chain 45 for inhibiting or slowing advancement of another erected outer container E along the conveyor 30. A pushing arm 47*b* also connects to and extends downwardly from the metering chain 45 for increasing advancement of another erected outer container E along the conveyor to the dispensed position. A discharge arm 47*c* likewise connects to and extends downwardly from the metering chain 45 for increasing advancement of a stuffed container S from the dispensed position to a discharged position.

It will be understood by those skilled in the art that other container positioning and/or timing means such as the metering means illustrated may also be used to position the outer container E in an appropriate location at an appropriate time for the stuffing or nesting operation in the dispensed position so as to maintain the stuffing or nesting process in a continuous manner (see FIG. 3). These other positioning and timing means, for example, may include a vacuum assist positioning and/or timing means, which may include the use of optical encoders and microprocessor based controls as well, and other mechanical and/or electrical operations that provide this type of positioning and timing functions.

As illustrated in FIGS. 1–7, and as described above, the present invention further includes methods of stuffing or nesting containers S. A method according to the present invention, for example, preferably includes erecting a collapsed inner container C during downstream advancement of the inner container C and inserting the erected inner container C into an open end O of an erected outer container E to thereby form a resulting stuffed container S (see FIG. 2). The method may also include dispensing an outer open-ended and erected container E to a dispensed position so that the open end O of the outer container E positionally aligns with the advancing inner container C (see FIG. 3). The step of dispensing the open-ended and erected outer container E preferably includes increasing the advancement of a first open-ended and erected outer container E to the dispensed position and slowing the advancement of a second open-ended and erected outer container E to the dispensed position (see, e.g., FIG. 5). The method may further include increasing the advancement of the second open-ended and erected outer container E and discharging the resulting stuffed container S from the dispensed position during the increased advancement of the second open-ended and erected outer container E.

Additionally, the collapsed inner container C described above may be a first collapsed inner container C, and the method further include dispensing a second collapsed inner container C during the step of erecting the first collapsed inner container C (see FIG. 3). The step of erecting the collapsed inner container C preferably includes holding a lower surface of the collapsed inner C container by vacuum pressure during the downstream advancement of the inner container C and lifting the upper surface of the collapsed inner container C by vacuum pressure during the downstream advancement of the inner container C (see FIGS. 3 and 4B).

A method of stuffing or nesting an inner container C into an open-ended outer container E is also provided which preferably includes increasing the advancement of a first of a plurality of open-ended and erected outer containers E being conveyed on a moving conveyor 30 to a dispensed position, slowing the advancement of a second of the plurality of open-ended and erected outer containers E being conveyed on the moving conveyor 30 to the dispensed position, and inserting an erected inner container C into the open end O of the first of the plurality of open-ended and erected outer containers E (see FIG. 5). This method may also include, for example, erecting a collapsed inner container C during downstream advancement of the inner container C.

As best illustrated in FIGS. 2–3 and 4A–4B, a method of dispensing and erecting containers C is further provided according to the present invention. This method preferably includes dispensing a first collapsed container C, erecting the first collapsed container during downstream advancement of the first container C, and dispensing a second collapsed container C during the step of erecting the first collapsed container C. The step of erecting the first collapsed container C comprises holding a lower surface of the first collapsed container C by vacuum pressure during the downstream advancement of the first container C and lifting the upper surface of the first collapsed container C by vacuum pressure during the downstream advancement of the first container C. The method may also include maintaining vacuum pressure on the erected first container during downstream advancement of the first container. This latter step, for example, can inhibit the first container C from returning to the collapsed position during downstream advancement to guides rails or other operations as understood by those skilled in the art. This method, for example, can not only be used for stuffing and/or nesting containers C, but may also advantageously be used for sealing the collapsed container C, e.g., bottom or top panels of the container C, once it is erected and other related methods as well according to the present invention.

Many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that the modifications and embodiments are intended to be included within the spirit and scope of the invention as described in the foregoing specification and as defined in the appended claims.

That which is claimed:

1. A container stuffing apparatus for enhancing the production speed of stuffed containers in a predetermined direction of manufacture, the apparatus comprising:

erected outer container dispensing means for dispensing one of a plurality of erected outer containers in the predetermined direction of manufacture, each outer container having at least one open end;

collapsed inner container dispensing means positioned positioned in another direction of manufacture substantially transverse to the predetermined direction of manufacture for dispensing one of a plurality of collapsed inner containers;

erecting means responsive to said collapsed inner container dispensing means for erecting the one dispensed and collapsed inner container, said erecting means including advancing means responsive to said collapsed inner container dispensing means for advancing the dispensed inner container downstream in a direction extending transversely toward the predetermined direction of manufacture during the erection of the inner container;

inner container inserting means responsive to said erecting means and said erected outer container dispensing means for inserting the erected inner container into the open end of the dispensed erected outer container to thereby provide a stuffed container; and timing synchronization control means operatively connected to said collapsed inner container dispensing means, said erecting means, and said inner container inserting means for controlling the timing synchronization of said collapsed inner container dispensing means, said erecting means, and said inner container inserting means so that said dispensing means dispenses another one of the plurality of collapsed containers during the erecting of the collapsed container and said erecting means erects another collapsed inner container during the inserting of the erected inner container.

2. A container stuffing apparatus as defined in claim 1, wherein said erected outer container dispensing means further includes metering means operatively connected to said timing synchronization control means for operatively metering a plurality of erected outer containers during dispensing of an erected outer container and during discharging of a stuffed container so that a first one of the plurality of erected outer containers advances to a dispensed position for receiving an erected inner container, a second one of the plurality of erected containers is being inhibited from advancing to the dispensed positioned, and the stuffed container advances to a discharge position.

3. A container stuffing apparatus as defined in claim 2, wherein said erected outer container dispensing means further comprises an elongate conveyor positioned in a generally horizontal plane and cooperating with said metering means for conveying a plurality of erected outer containers to be stuffed.

4. A container stuffing apparatus as defined in claim 3, wherein said metering means comprises a stop gate positioned to stop conveying movement of the plurality of erected outer containers being conveyed by said conveyor toward the dispensed position, a guide gate positioned to guide and stop conveying movement of the erected dispensed container during insertion of the inner erected container, a metering chain overlying said elongate conveyor, a metering arm connected to and extending downwardly from said metering chain for slowing advancement of another erected outer container, and a pushing arm connected to and extending downwardly from said metering chain for increasing advancement of another erected outer container to the dispensed position.

5. A container stuffing apparatus as defined in claim 4, wherein said erecting means further comprises position maintaining means for maintaining the erected container in an erected position during downstream advancement by said advancing means.

6. A container stuffing apparatus as defined in claim 1, wherein said erecting means further includes movable carriage means positioned adjacent the plane of travel of the dispensed inner container for carrying at least portions of said erecting means during downstream advancement by said advancing means.

7. A container stuffing apparatus as defined in claim 6, wherein said erecting means further includes a vacuum source for supplying a vacuum, an elongate tube having portions thereof mounted to said carriage means and having a proximal end thereof connected to said vacuum source, and a retractable container contact member mounted to said carriage means, connected to a distal end of said elongate tube, and arranged to be positioned to overlie the dispensed collapsed inner container in an engaged position, said contact member having an opening therein positionally aligned with the distal opening of said elongate tube for providing vacuum contact to an upper surface of the collapsed inner container to thereby lift the upper surface of the collapsed inner container to an erect position, and said retractable contact member being arranged to be positioned away from the inner container in a disengaged position.

8. A container stuffing apparatus as defined in claim 6, wherein said movable carriage means of said inner container erecting means further comprises a pivot arm connected to said contact member for pivotally moving said contact member from the engaged position to the disengaged position, biasing means connected to said pivot arm for biasing said pivot arm in the engaged position, and lifting means connected to said pivot arm for lifting said pivot arm upwardly away from the said conveyor during movement of said conveyor.

9. A container stuffing apparatus as defined in claim 1, wherein said advancing means of said erecting means comprises a conveyor positioned in a generally horizontal plane downstream from said inner container dispensing means for conveying the dispensed inner container toward the dispensed outer container and driving means mounted to said conveyor for driving the conveyor in the generally horizontal plane, said driving means including drive deceleration means for decelerating the drive speed of said conveyor as the erected inner container conveyed thereon is being inserted into the open end of the erected outer container and as the dispensed collapsed container is beginning to be conveyed to thereby provide a more smooth conveying movement.

10. A container stuffing apparatus as defined in claim 1, wherein said inner container inserting means comprises at least two retractable pushing arms positioned to abuttingly contact periphery portions of the erected inner container for pushing the erected inner container from a retracted non-stuffed position to an extended stuffed position and at least two guide members positioned downstream from said at least two retractable pushing arms for guiding the erected inner container during the pushing thereof into the open end of the erected outer container.

11. A container stuffing apparatus as defined in claim 10, wherein said at least two guide members comprise four corner guides respectively positioned to receive the four corners of the erected inner container and to pivotally guide the four corners during insertion into the open end of the erected outer container and pivotal mounting means connected to said four corner guides for pivotally mounting said four corner guides to inhibit damage to the erected inner container during insertion into the open end of the erected outer container.

12. A container stuffing apparatus for enhancing the production speed of stuffed containers in a predetermined direction of manufacture, the apparatus comprising:

erected outer container dispensing means for dispensing one of a plurality of erected outer containers, each erected outer container having at least one open end, said erected outer container dispensing means including metering means for operatively metering a plurality of erected outer containers during dispensing of an erected outer container and during discharging of a stuffed container so that said metering means advances a first one of the plurality of erected outer containers to a dispensed position for receiving an erected inner container, inhibits a second one of the plurality of erected outer containers from advancing to the dispensed position, and advances the stuffed container to a discharge position;

collapsed inner container dispensing means positioned in another direction of manufacture substantially transverse to the predetermined direction of manufacture for dispensing one of a plurality of collapsed inner containers;

erecting means positioned downstream in a direction extending transversely toward the predetermined direction of manufacture for erecting the one dispensed and collapsed inner container; and inner container inserting means positioned downstream from said erecting means and extending substantially transverse to the predetermined direction of manufacture for inserting the erected inner container into the open end of the dispensed erected outer container to thereby provide a stuffed container.

13. A container stuffing apparatus as defined in claim 12, further comprising timing synchronization control means operatively connected to said collapsed inner container dispensing means, said erecting means, said inner container inserting means, and said metering means of said erected outer container dispensing means for controlling the timing synchronization of said collapsed inner container dispensing means, said erecting means, and said inner container inserting means so that said dispensing means dispenses another one of the plurality of collapsed containers during the erecting of the collapsed container and said erecting means erects another collapsed inner container during the inserting of the erected inner container.

14. A container stuffing apparatus as defined in claim 12, wherein said erected outer container dispensing means further comprises an elongate conveyor positioned in a generally horizontal plane and cooperating with said metering means for conveying a plurality of erected outer containers to be stuffed.

15. A container stuffing apparatus as defined in claim 14, wherein said metering means comprises a stop gate positioned to stop conveying movement of the plurality of erected outer containers being conveyed by said conveyor toward the dispensed position, a guide gate positioned to guide and stop conveying movement of the erected dispensed container during insertion of the inner erected container, a metering chain overlying said elongate conveyor, a metering arm connected to and extending downwardly from said metering chain for slowing advancement of another erected outer container, and a pushing arm connected to and extending downwardly from said metering chain for increasing advancement of another erected outer container to the dispensed position.

16. A container stuffing apparatus as defined in claim 12, wherein said erecting means comprises advancing means responsive to said collapsed inner container dispensing means for advancing the dispensed inner container downstream during the erection of the inner container and movable carriage means positioned adjacent the plane of travel of the dispense inner container for carrying at least portions of said erecting means during downstream advancement by said advancing means.

17. A container stuffing apparatus as defined in claim 16, wherein said erecting means further comprises position maintaining means for maintaining the erected container in an erected position during downstream advancement by said advancing means.

18. A container stuffing apparatus as defined in claim 17, wherein said erecting means further includes a vacuum source for supplying a vacuum, an elongate tube having portions thereof mounted to said carriage means and having a proximal end thereof connected to said vacuum source, and a retractable container contact member mounted to said carriage means, connected to a distal end of said elongate tube, and arranged to be positioned to overlie the dispensed collapsed inner container in an engaged position, said contact member having an opening therein positionally aligned with the distal opening of said elongate tube for providing vacuum contact to an upper surface of the collapsed inner container to thereby lift the upper surface of the collapsed inner container to an erect position, and said retractable contact member being arranged to be positioned away from the inner container in a disengaged position.

19. A container stuffing apparatus as defined in claim 18, wherein said movable carriage means of said inner container erecting means further comprises a pivot arm connected to said contact member for pivotally moving said contact member from the engaged position to the disengaged position, biasing means connected to said pivot arm for biasing said pivot arm in the engaged position, and lifting means connected to said pivot arm for lifting said pivot arm upwardly away from the said conveyor during movement of said conveyor, and wherein said position maintaining means includes a dwell position so that said pivot arm dwells in an upwardly extended position away from said conveyor during advancement downstream of an inner container positioned thereon.

20. A container stuffing apparatus as defined in claim 17, wherein said advancing means of said erecting means comprises a conveyor positioned in a generally horizontal plane downstream from said inner container dispensing means for conveying the dispensed inner container toward the dispensed outer container and driving means mounted to said conveyor for driving the conveyor in the generally horizontal plane, said driving means including drive deceleration means for decelerating the drive speed of said conveyor as the erected inner container conveyed thereon is being inserted into the open end of the erected outer container and as the dispensed collapsed container is beginning to be conveyed to thereby provide a more smooth conveying movement.

21. A container stuffing apparatus as defined in claim 12, wherein said inner container inserting means comprises at least two retractable pushing arms positioned to abuttingly contact periphery portions of the erected inner container for pushing the erected inner container from a retracted non-stuffed position to an extended stuffed position and at least two guide members positioned downstream from said at least two retractable pushing arms for guiding the erected inner container during the pushing thereof into the open end of the erected outer container.

22. A container stuffing apparatus as defined in claim 21, wherein said at least two guide members comprise four corner guides respectively positioned to receive the four corners of the erected inner container and to pivotally guide the four corners during insertion into the open end of the erected outer container and pivotal mounting means connected to said four corner guides for pivotally mounting said four corner guides to inhibit damage to the erected inner container during insertion into the open end of the erected outer container.

23. A container stuffing apparatus for enhancing production speed of stuffed containers in a predetermined direction of manufacture, the apparatus comprising:

an erected outer container dispenser for individually dispensing a rectangular-shaped erected outer container having at least one open end, said erected outer container dispenser including an erected outer container conveyor positioned in a generally horizontal plane for conveying a plurality of erected outer containers and an outer container meter responsive to said outer container conveyor for operatively metering the plurality of erected outer containers during individual dispensing of an erected outer container and individual discharging of a stuffed container so that said meter advances a first one of the plurality of erected outer containers to a dispensed position for receiving an erected outer container, inhibits a second one of the plurality of erected outer containers from advancing to the dispensed position, and advances the stuffed container to a discharge position;

a collapsed inner container dispenser positioned in another direction of manufacture substantially transverse to the predetermined direction of manufacture for individually dispensing a collapsed inner container, said collapsed inner container dispenser including a plurality of stacked collapsed inner containers positioned for dispensing therefrom;

an inner container erector positioned downstream in a direction extending transversely toward the predetermined direction of manufacture and responsive to said collapsed inner container dispenser for individually erecting the dispensed and collapsed inner container, said inner container erector including an inner container conveyor positioned in a generally horizontal plane and transverse to said outer container conveyor and responsive to said collapsed inner container dispenser for conveying the dispensed inner container toward the dispensed outer container during the erection of the inner container;

an inner container inserter positioned downstream from and responsive to said inner container erector and in the direction extending transversely toward the predetermined direction of manufacture for inserting the erected inner container into the open end of the dispensed erected outer container to thereby provide a stuffed container; and a timing synchronization controller operatively connected to said erected outer container dispenser, said collapsed inner container dispenser, said inner container erector, and said inner container inserter for controlling the timing synchronization of said collapsed inner container dispenser, said erector, and said inserter so that said inner container dispenser dispenses another one of the plurality of collapsed containers during the erecting of the collapsed container and said erector erects another collapsed inner container during the inserting of the erected inner container.

24. A container stuffing apparatus as defined in claim 23, wherein said erected outer container dispenser further comprises an elongate conveyor positioned in a generally horizontal plane and cooperating with said outer container meter for conveying a plurality of erected outer containers to be stuffed and discharged.

25. A container stuffing apparatus as defined in claim 24, wherein said outer container meter comprises a stop gate positioned to stop conveying movement of the plurality of erected outer containers being conveyed by said conveyor toward the dispensed position, a guide gate positioned to guide and stop conveying movement of the erected dispensed container during insertion of the inner erected container in a closed position and to releasably permit advancement by said conveyor to discharge the stuffed container in an open position, a metering chain overlying said elongate conveyor, a metering arm connected to and extending downwardly from said metering chain for slowing advancement of another erected outer container along said conveyor, and a pushing arm connected to and extending downwardly from said metering chain for increasing advancement of another erected outer container along said conveyor to the dispensed position.

26. A container stuffing apparatus as defined in claim 25, wherein said inner container erector further comprises a movable carriage positioned adjacent the plane of travel of the dispense inner container for carrying at least portions of said erector during downstream advancement by said conveyor.

27. A container stuffing apparatus as defined in claim 26, wherein said erecting means further comprises position maintaining means for maintaining the erected container in an erected position during downstream advancement by said advancing means.

28. A container stuffing apparatus as defined in claim 27, wherein said erector further includes a vacuum source for supplying a vacuum, a pair of elongate tubes having proximal ends thereof connected to said vacuum source, one of said pair of elongate tubes having portions thereof mounted to said carriage, an retractable upper contact member mounted to said carriage, connected to a distal end of said one of said pair of elongate tubes, and arranged to be positioned to overlie the dispensed collapsed inner container in an engaged position, said retractable upper contact member having an opening therein positionally aligned with the distal opening of said one of said pair of elongate tubes for providing vacuum contact to an upper surface of the collapsed inner container to thereby lift the upper surface of the collapsed inner container to an erect position, and said retractable upper contact member being arranged to be positioned away from the inner container in a disengaged position, and a lower contact member connected to a distal end of the other of said pair of elongate tubes for contacting a lower surface of the inner container, said lower contact member having an opening therein positionally aligned with the distal opening of said other of said pair of elongate tubes for providing vacuum contact to a lower surface of the collapsed inner container to thereby hold the lower surface of the collapsed inner container during erection.

29. A container stuffing apparatus as defined in claim 28, wherein said movable carriage of said inner container erector further comprises a pivot arm connected to said retractable upper contact member for pivotally moving said upper contact member from the engaged position to the disengaged position, biasing means connected to said pivot arm for biasing said pivot arm in the engaged position, and lifting means connected to said pivot arm for lifting said pivot arm upwardly away from the said conveyor during movement of said conveyor, and wherein said position maintaining means includes a dwell position so that said pivot arm dwells in an upwardly extended position away from said conveyor during advancement downstream of an inner container positioned thereon.

30. A container stuffing apparatus as defined in claim 29, wherein said erector further comprises a conveyor drive mounted to said conveyor for driving the conveyor in the generally horizontal plane, said conveyor drive including a drive decelerator for decelerating the drive speed of said conveyor as the erected inner container conveyed thereon is being inserted into the open end of the erected outer container and as the dispensed collapsed container is beginning to be conveyed to thereby provide a more smooth conveying movement.

31. A container stuffing apparatus as defined in claim 30, wherein said inner container inserter comprises at least two retractable pushing arms positioned to abuttingly contact periphery portions of the erected inner container for pushing the erected inner container from a retracted non-stuffed position to an extended stuffed position and at least two guide members positioned downstream from said at least two retractable pushing arms for guiding the erected inner container during the pushing thereof into the open end of the erected outer container.

32. A container stuffing apparatus as defined in claim 31, wherein said at least two guide members comprise four corner guides respectively positioned to receive the four corners of the erected inner container and to pivotally guide the four corners during insertion into the open end of the erected outer container and a plurality of pivotal mounts respectively connected to said four corner guides for pivotally mounting said four corner guides to inhibit damage to the erected inner container during insertion into the open end of the erected outer container.

33. A container erecting and inserting apparatus for enhancing the production speed of erected stuffed container in a predetermined direction of manufacture, the apparatus comprising:

collapsed container dispensing means positioned in another direction of manufacture substantially transverse to the predetermined direction of manufacture for dispensing one of a plurality of collapsed inner containers;

erecting means positioned downstream from said collapsed container dispensing means for erecting the one dispensed and collapsed container, said erecting means including advancing means responsive to said collapsed container dispensing means for advancing the dispensed container downstream during the erection of the container;

container inserting means positioned downstream from said erecting means for forwardly inserting the erected container downstream in a direction substantially transverse to the predetermined direction of manufacture; and timing synchronization control means operatively connected to said collapsed container dispensing means, said erecting means, and said container inserting means for controlling the timing synchronization of said collapsed container dispensing means, said erecting means, and said container inserting means so that said dispensing means dispenses another one of the plurality of collapsed containers during the erecting of the collapsed container and said erecting means erects another collapsed container during the inserting of the erected container.

34. A container erecting and inserting apparatus as defined in claim 33, wherein said erecting means further includes movable carriage means positioned adjacent the plane of travel of the dispensed container for carrying at least portions of said erecting means during downstream advancement by said advancing means.

35. A container erecting and inserting apparatus as defined in claim 34, wherein said erecting means further includes a vacuum source for supplying a vacuum, an elongate tube having portions thereof mounted to said carriage means and having a proximal end thereof connected to said vacuum source, and a retractable container contact member mounted to said carriage means, connected to a distal end of said elongate tube, and arranged to be positioned to overlie the dispensed collapsed container in an engaged position, said contact member having an opening therein positionally aligned with the distal opening of said elongate tube for providing vacuum contact to an upper surface of the collapsed container to thereby lift the upper surface of the collapsed container to an erect position, and said retractable contact member being arranged to be positioned away from the erected container in a disengaged position.

36. A container erecting and inserting apparatus as defined in claim 35, wherein said movable carriage means of said erecting means further comprises a pivot arm connected to said contact member for pivotally moving said contact member from the engaged position to the disengaged position, biasing means connected to said pivot arm for biasing said pivot arm in the engaged position, and lifting means connected to said pivot arm for lifting said pivot arm upwardly away from the said conveyor during movement of said conveyor.

37. A container erecting and inserting apparatus as defined in claim 36, wherein said advancing means of said erecting means comprises a conveyor positioned in a generally horizontal plane downstream from said collapsed container dispensing means for conveying the dispensed container downstream and driving means mounted to said conveyor for driving the conveyor in the generally horizontal plane, said driving means including drive deceleration means for decelerating the drive speed of said conveyor as the erected container conveyed thereon is being inserted downstream and as the dispensed collapsed container is beginning to be conveyed to thereby provide a more smooth conveying movement.

38. A container erecting and inserting apparatus as defined in claim 37, wherein said container inserting means comprises at least two retractable pushing arms positioned to abuttingly contact periphery portions of the erected container for pushing the erected container downstream and at least two guide members positioned downstream from said at least two retractable pushing arms for guiding the erected container during the pushing thereof into an open end of another erected container.

39. A container erecting and inserting apparatus as defined in claim 38, wherein said at least two guide members comprise four corner guides respectively positioned to receive the four corners of the erected inner container and to pivotally guide the four corners during insertion into an open end of another erected container and pivotal mounting means connected to said four corner guides for pivotally mounting said four corner guides to inhibit damage to the erected container being inserted into an open end of another erected outer container.

40. A container stuffing apparatus as defined in claim 33, wherein said erecting means further comprises position maintaining means for maintaining the erected container in an erected position during downstream advancement by said advancing means.

* * * * *

UNITED STATES PATENT AND TRADEMARK OFFICE

CERTIFICATE OF CORRECTION

PATENT NO. : 5,916,078
DATED : June 29, 1999
INVENTOR(S) : HERRIN

It is certified that error appears in the above-indentified patent and that said Letters Patent is hereby corrected as shown below:

In Claim 1, line 55, delete "positioned".

In Claim 33, line 22, delete "container" and insert
- -containers- -therefor.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*